US012753945B2

(12) United States Patent
Manga et al.

(10) Patent No.: US 12,753,945 B2
(45) Date of Patent: Oct. 6, 2026

(54) INTEGRATED LIGHTING SYSTEM FOR DIFFUSER OF AN HVAC SYSTEM

(71) Applicant: Air Distribution Technologies IP, LLC, Milwaukee, WI (US)

(72) Inventors: Wasim Wahab Manga, Pune (IN); Vishal Krishna Yeole, Pune (IN); Manoj Patel, Raigarh (IN); Kaushal Ishwarlal Khanore, Pune (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 19/075,325

(22) Filed: Mar. 10, 2025

(65) Prior Publication Data

US 2025/0290658 A1 Sep. 18, 2025

(30) Foreign Application Priority Data

Mar. 14, 2024 (IN) ..... 202421018652

(51) Int. Cl.
*F24F 13/078* (2006.01)

(52) U.S. Cl.
CPC ..... *F24F 13/078* (2013.01)

(58) Field of Classification Search
CPC ..... F24F 13/078
See application file for complete search history.

(56) References Cited

U.S. PATENT DOCUMENTS

| | | | | |
|---|---|---|---|---|
| 4,008,654 | A | 2/1977 | Stahlhut et al. | |
| 2005/0141216 | A1* | 6/2005 | McCarthy | F24F 13/078 362/147 |
| 2012/0302152 | A1 | 11/2012 | Dyck et al. | |
| 2019/0346096 | A1* | 11/2019 | Warner | F21V 33/0088 |
| 2020/0018515 | A1* | 1/2020 | Awasthi | F24F 13/072 |
| 2022/0090778 | A1* | 3/2022 | Chung | F24F 13/078 |
| 2023/0094666 | A1* | 3/2023 | Allen | F21V 33/0088 362/96 |
| 2023/0341146 | A1* | 10/2023 | Renson | F24F 13/078 |
| 2024/0255180 | A1* | 8/2024 | Branham | F24H 3/0411 |
| 2025/0244031 | A1* | 7/2025 | Zakula | F24F 7/007 |
| 2025/0271132 | A1* | 8/2025 | Ogawa | F24F 13/08 |

FOREIGN PATENT DOCUMENTS

| | | | |
|---|---|---|---|
| DE | 202015101209 | U1 | 6/2016 |
| EP | 2610541 | A1 | 7/2013 |
| FR | 2982927 | A1 | 5/2013 |
| KR | 20120005436 | U | 7/2012 |

OTHER PUBLICATIONS

International Search Report and Written Opinion for Application No. PCT/US2025/019195 dated Jun. 13, 2025 (13 pages).

* cited by examiner

*Primary Examiner* — Christopher E Dunay
(74) *Attorney, Agent, or Firm* — Michael Best & Friedrich LLP

(57) ABSTRACT

An integrated diffuser assembly for a heating, ventilation, and air conditioning (HVAC) system, including: a diffuser configured to discharge an air flow into a conditioned space along an air flow path, wherein the diffuser includes a flange extending outwardly along a length of the diffuser, wherein the flange includes a channel extending along the flange; and a lighting element disposed within the channel such the lighting element is disposed outwardly from the air flow path, the lighting element configured to provide light to the conditioned space.

16 Claims, 8 Drawing Sheets

INTEGRATED LIGHTING SYSTEM FOR DIFFUSER OF AN HVAC SYSTEM

CROSS-REFERENCE TO RELATED APPLICATIONS

This application claims priority to Indian Provisional Patent Application No. 202421018652, filed on Mar. 14, 2024, the entire contents of which are incorporated herein by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. Generally, an HVAC system may control environmental properties by controlling a supply air flow delivered to the environment. For example, the HVAC system may place the supply air flow in a heat exchange relationship with a refrigerant of a vapor compression circuit to condition the supply air flow. A HVAC system may control environmental properties by supplying an air flow to the environment via a diffuser. For example, a diffuser may be installed in a ceiling of a room and receive air from a duct of the HVAC system. The diffuser directs and diffuses the air into the room. Of course, a ceiling space may also include various ceiling mounted devices, such as light fixtures, speakers, and cameras.

SUMMARY

A summary of certain examples disclosed herein is set forth below. It should be understood that these aspects are presented merely to provide the reader with a brief summary of these certain examples and that these aspects are not intended to limit the scope of this disclosure. Indeed, this disclosure may encompass a variety of aspects that may not be set forth below.

As noted above, a ceiling in a building often includes a diffuser and other devices. Unfortunately, multiple objects or components mounted to a ceiling may elicit a sense of visual clutter that may aesthetically degrade the environment. Therefore, improved installation of diffusers and other devices installed with or for a room is desired.

In one example, an integrated diffuser assembly for a heating, ventilation, and air conditioning (HVAC) system includes a diffuser configured to discharge an air flow into a conditioned space. The diffuser includes flange extending a length of the diffuser. The flange includes a channel extending along the flange. The integrated diffuser assembly further includes one or more lighting elements disposed within channel.

In some aspects, the techniques described herein relate to an integrated diffuser assembly for a heating, ventilation, and air conditioning (HVAC) system, including: a diffuser configured to discharge an air flow into a conditioned space along an air flow path, wherein the diffuser includes a flange extending outwardly along a length of the diffuser, wherein the flange includes a channel extending along the flange; and a lighting element disposed within the channel such the lighting element is disposed outwardly from the air flow path, the lighting element configured to provide light to the conditioned space.

In some aspects, the techniques described herein relate to an integrated diffuser assembly, wherein the diffuser includes a first frame member and a second frame member coupled to the first frame member and defining the air flow path therebetween for guiding the air flow into the conditioned space, one of the first frame member and the second frame member including the flange.

In some aspects, the techniques described herein relate to an integrated diffuser assembly, wherein the diffuser further includes a pattern controller positioned between the first frame member and the second frame member and within the air flow path, the pattern controller configured to adjust the air flow into the conditioned space.

In some aspects, the techniques described herein relate to an integrated diffuser assembly, wherein the flange is a first flange, and wherein the one of the first frame member and the second frame member includes a second flange extending inwardly along the length of the diffuser.

In some aspects, the techniques described herein relate to an integrated diffuser assembly, wherein the lighting element includes an engagement interface that is complementary to an engagement interface of the channel.

In some aspects, the techniques described herein relate to an integrated diffuser assembly, wherein one of the lighting element or the channel includes a projection extending along a length thereof and the other of the lighting element and the channel includes a recess extending along a length thereof, the recess configured to receive the projection to engage the lighting element with the channel.

In some aspects, the techniques described herein relate to an integrated diffuser assembly, wherein the lighting element includes a plurality of light emitters.

In some aspects, the techniques described herein relate to an integrated diffuser assembly for a heating, ventilation, and air conditioning (HVAC) system, including: a diffuser including a diffuser frame configured to guide an air flow along an air flow path to discharge the air flow to a conditioned space, the diffuser frame including a first frame member including a first frame wall partially extending along a length of the diffuser, a flange extending outwardly from the first frame wall along the length of the diffuser, and a channel extending along the flange; and a second frame member having a second frame wall extending along the length of the diffuser, wherein the first frame wall and the second frame wall define the air flow path; and a lighting element coupled to the diffuser frame and disposed within the channel such that the lighting element is positioned outwardly from the air flow path.

In some aspects, the techniques described herein relate to an integrated diffuser assembly, wherein the lighting element includes an engagement interface that is complementary to an engagement interface of the channel.

In some aspects, the techniques described herein relate to an integrated diffuser assembly, wherein the diffuser further includes a pattern controller positioned between the first frame wall and the second frame wall and within the air flow path, the pattern controller configured to adjust the air flow into the conditioned space.

In some aspects, the techniques described herein relate to an integrated diffuser assembly, wherein the flange is a first flange, and wherein the first frame member includes a second flange extending inwardly from the first frame wall along the length of the diffuser.

In some aspects, the techniques described herein relate to an integrated diffuser assembly, wherein the flange is a first flange, the channel is a first channel, and the air flow path is a first air flow path, and the lighting element is a first lighting element, and wherein the diffuser frame further includes a third frame member including a third frame wall partially extending along the length of the diffuser, a second flange extending outwardly from the third frame wall along the length of the diffuser, and a second channel extending along the second flange, wherein the second frame wall and the third frame wall define a second air flow path configured to guide the air flow to the conditioned space; and a second lighting element coupled to the diffuser frame and disposed within the second channel such that the second lighting element is positioned outwardly from the second air flow path.

In some aspects, the techniques described herein relate to an integrated diffuser assembly, wherein the first air flow path and the second air flow path are positioned between the first lighting element and the second lighting element.

In some aspects, the techniques described herein relate to an integrated diffuser assembly, wherein the diffuser further includes a first pattern controller positioned between the first frame wall and the second frame wall and within the first air flow path and a second pattern controller positioned between the second frame wall and the third frame wall and within the second air flow path, the first pattern controller and the second pattern controller each configured to adjust the air flow into the conditioned space.

In some aspects, the techniques described herein relate to an integrated diffuser assembly, wherein the first frame member includes a third flange extending inwardly therefrom along the length of the diffuser and the third frame member includes a fourth flange extending inwardly therefrom.

In some aspects, the techniques described herein relate to an integrated diffuser assembly, wherein the lighting element includes a plurality of light emitters.

In some aspects, the techniques described herein relate to an integrated diffuser assembly for a heating, ventilation, and air conditioning (HVAC) system, including: a diffuser configured to discharge an air flow into a conditioned space along an air flow path, wherein the diffuser includes a flange extending outwardly along a length of the diffuser, wherein the flange includes a channel extending along the flange; a pattern controller supported by the diffuser and positioned within the air flow path, the pattern controller configured to adjust the air flow into the conditioned space; and a lighting element disposed within the channel such the lighting element is disposed outwardly from the air flow path and the pattern controller, the lighting element configured to provide light to the conditioned space.

In some aspects, the techniques described herein relate to an integrated diffuser assembly, wherein the flange is a first flange, the channel is a first channel, and the lighting element is a first lighting element, and wherein the diffuser further includes a second flange extending outwardly along the length of the diffuser, wherein the second flange includes a second channel extending along the second flange, and a second lighting element disposed within the second channel such the second lighting element is disposed outwardly from the air flow path, the second lighting element configured to provide light to the conditioned space, wherein the air flow path is positioned between the first lighting element and the second lighting element.

In some aspects, the techniques described herein relate to an integrated diffuser assembly, wherein one of the lighting element or the channel includes a projection extending along a length thereof and the other of the lighting element and the channel includes a recess extending along a length thereof, the recess configured to receive the projection to engage the lighting element with the channel.

In some aspects, the techniques described herein relate to an integrated diffuser assembly, wherein the lighting element includes a plurality of light emitters.

BRIEF DESCRIPTION OF THE DRAWINGS

Various aspects of this disclosure may be better understood upon reading the following detailed description and upon reference to the drawings in which.

DETAILED DESCRIPTION

Figure 1:
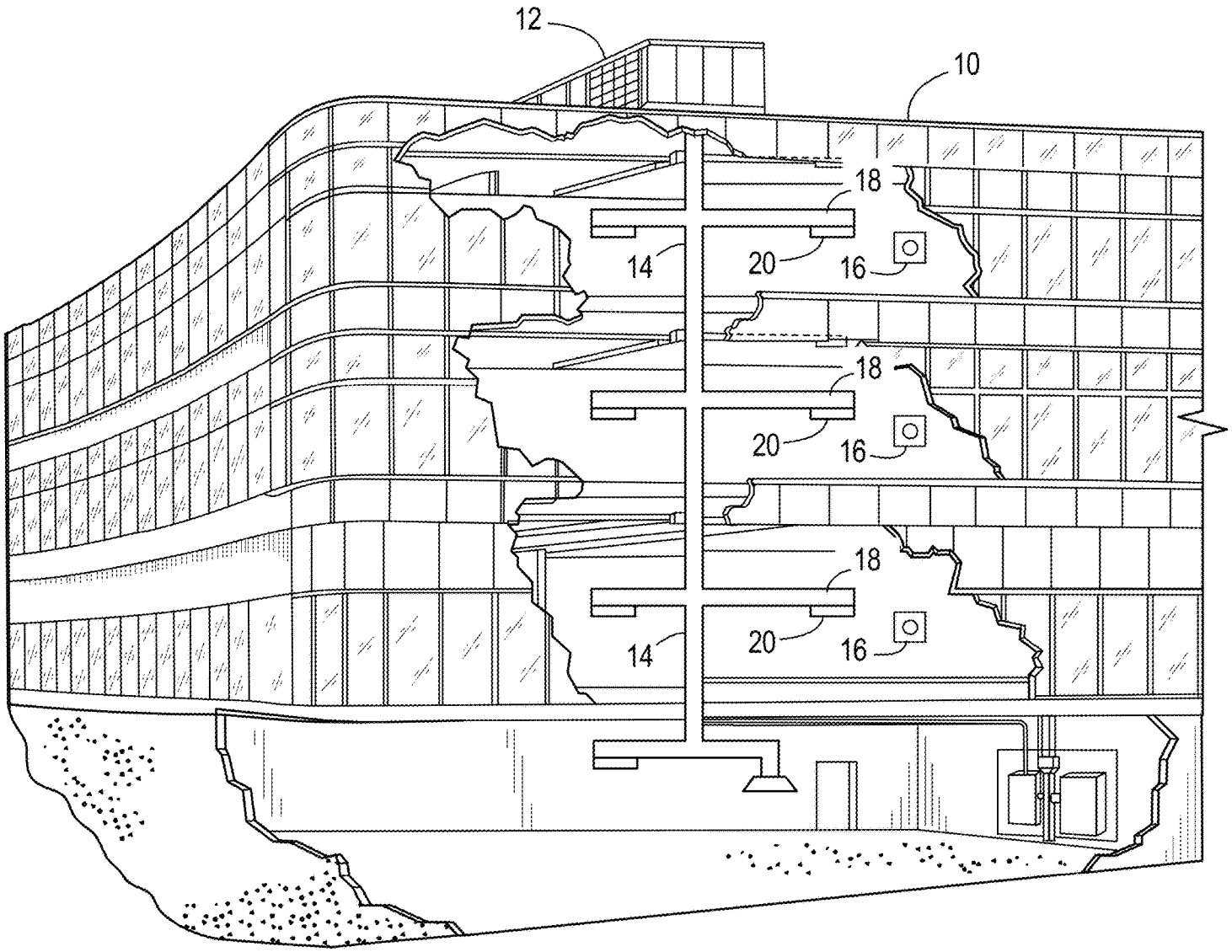
FIG. 1 is a perspective view of an example of a building including a heating, ventilation, and/or air conditioning (HVAC) system for environmental management, in accordance with an aspect of the present disclosure.

One or more specific examples will be described below. In an effort to provide a concise description of these examples, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various examples of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one example" or "an example" of the present disclosure are not intended to be interpreted as excluding the existence of additional examples that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. The HVAC system may include an HVAC unit configured to condition an air flow via an evaporator, a furnace, a heating coil, a chiller system, another heat exchange system, or a combination thereof, and to provide the conditioned air flow (e.g., a heated air flow, a cooled air flow, a dehumidified air flow) to the space. For example, the HVAC unit may be fluidly coupled to the space via an air distribution system, such as a system of ductwork, which extends between the HVAC unit and the space. One or more fans or blowers of the HVAC system may be operable to direct a supply of conditioned air from the HVAC unit, through the ductwork, and into the spaces within the building. Typically, the HVAC system includes one or more diffusers that are fluidly coupled to the ductwork and are configured to facilitate distribution of air from the ductwork into the rooms or spaces of the building. For example, the diffusers may be positioned adjacent to ceilings, floors, and/or walls of the rooms conditioned by the HVAC system and may be configured to discharge air from the ductwork into the rooms or other spaces. Upon receiving the air flow, the diffuser may change a velocity and/or a static pressure of the air flow and dispense a diffused air flow to the environment.

In certain systems, diffusers (e.g., architectural diffusers) may be designed to appear inconspicuous and harmonious with the environment. For example, a linear slot diffuser may encase or occupy an elongated, narrow opening in the ceiling, such that an observer in the room may merely perceive one or more thin slots in the ceiling rather than a visually obtrusive apparatus. The linear slot diffuser may include border flanges situated (e.g., mounted, flush) against the ceiling to physically and visually define a perimeter around the opening. The border flanges may provide a mounting surface for the diffuser against the ceiling as well as help guide the air flow through the diffuser.

Meanwhile, the environment may include or be associated with lighting systems having light fixtures. Such light fixtures may be installed in or on the ceiling or wall of the environment. A visual presence or overabundance of these diffusers and light fixtures in a ceiling may contribute to material or aesthetic clutter as the devices compete physically and/or visually to occupy a limited space provided by the ceiling. In other words, a ceiling having clean and seamless appearance may be preferred to a ceiling that contains a number of visually disparate lighting and diffuser installations.

Keeping the foregoing in mind, it is presently recognized that incorporating a lighting system with a diffuser to provide an integrated assembly (e.g., diffuser assembly) may improve aesthetic qualities (e.g., better achieve a minimalist aesthetic) of the environment by combining and/or integrating the lighting system and the diffuser to occupy a common visual space. As described in further detail below, examples of the present disclosure include a diffuser assembly having a lighting system coupled to a diffuser. In some examples, the diffuser may be a linear slot diffuser having one or more recesses (e.g., grooves, channels) formed along border flanges around and/or along a perimeter of the diffuser. Lighting elements of the lighting system may be positioned (e.g., embedded, inserted, recessed) in the recesses of the border flanges. From the environment, the lighting elements and the border flanges may appear to share a common visual space in the plane of the ceiling. In some installations, the lighting elements may be substantially hidden from view within a conditioned space having the integrated assembly, thereby further improving the aesthetics of the conditioned space while nevertheless providing desired functionalities associated with the diffuser and the lighting system. The lighting elements may be coupled to the diffuser in a manner that does not involve substantial or appreciable modification of a physical appearance of the opening and/or the diffuser. Moreover, the lighting elements may provide ambient and direct lighting to the space. Accordingly, present examples enable installation of diffusers and lighting systems in an integrated manner. Further, the techniques disclosed herein enable integrated operation of the diffusers and lighting systems. In this way, diffusers and lighting systems may be installed and utilized with minimal detraction from aesthetic appeal of the environment. While the discussion below describes the present techniques in a ceiling-mounted context, it should be appreciated that systems and elements thereof hereinafter described as being disposed along a ceiling may be adapted for installation along a wall, a floor, or other suitable surface.

Turning now to the drawings, FIG. 1 illustrates an example of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The examples described herein may be utilized in a variety of applications to control climate characteristics, such as residential, commercial, industrial, transportation, or other applications where climate control is desired.

In the illustrated example, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit.

The HVAC unit 12 may be an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated example, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain examples, the HVAC unit 12 may be a heat pump that provides both heating and cooling to the building with one refrigeration circuit configured to operate in different modes. In other examples, the HVAC unit 12 may include one or more refrigeration circuits for cooling an air stream and a furnace for heating the air stream.

A control device 16, one type of which may be a thermostat, may be used to set the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some examples, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

The ductwork 14 may include one or more duct outlets 18 configured to enable discharge of air (e.g., supply air) into the building 10. As shown, a diffuser 20 (e.g., diffuser assembly, integrated diffuser assembly) may be fluidly coupled to each duct outlet 18 to enable discharge conditioned air from the ductwork 14 to a conditioned space (e.g., a room) of the building 10. For example, the diffuser 20 may be configured to receive a flow of supply air from the ductwork 14 and change the velocity, static pressure, turbulence, and/or other properties of the supply air before the supply air is provided to the conditioned space. In some examples, two or more conjoined diffusers (e.g., a first diffuser and a second diffuser, a diffuser assembly) may be commonly located at one of the duct outlets 18.

The diffuser 20 may be configured to receive an air flow from the ductwork 14 and redirect the air flow in one or more directions (e.g., into a room) at an adjusted (e.g., lower) velocity. For example, one or more structures (e.g., pattern controllers, bars, plates, flaps, grilles, channels, plaques, panels, dampers) within the diffuser 20 may deflect or partially divert the air flow, thereby causing the air flow to disperse and flow into the room. Furthermore, the diffuser 20 may change the cross-sectional area of the air flow and thereby change an average velocity of the air flow. In this way, conditioned air may enter the space with a desired (e.g., more uniform) distribution and without unwanted drafts. Moreover, noise generated by HVAC system (e.g., HVAC unit 12) may be reduced (e.g., damped) by altering the air flow. In other examples, the diffuser 20, such as a jet diffuser, may be configured to discharge air into a room in a concentrated direction. In any case, the diffuser 20 may alter or redirect the air flow in a desired manner before or as the air is distributed to the conditioned space.

Figure 2:
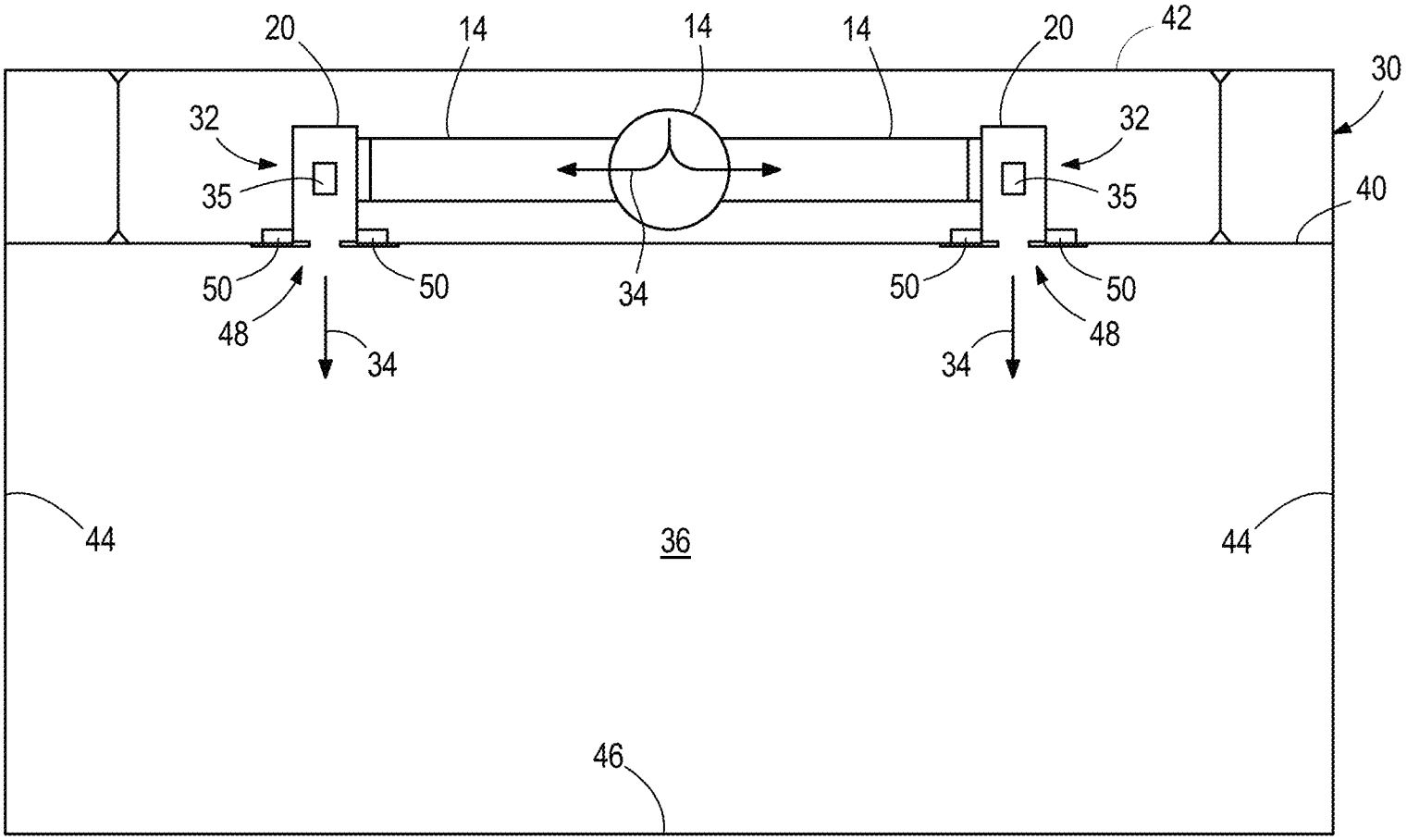
FIG. 2 is a is a schematic of an example of a room of a building having diffuser assemblies, in accordance with an aspect of the present disclosure.

FIG. 2 is a schematic of an example of a room 30 of the building 10, illustrating diffuser assemblies 32 coupled to ductwork 14. The diffuser assemblies 32 may include diffusers 20 fluidly coupled to the ductwork 14 to receive a flow of conditioned air 34, which may be generated by the HVAC unit 12, for example. Additionally, the diffusers 20 (e.g., the diffuser assemblies 32) may include pattern controllers 35 configured to guide the air flow out of the diffusers 20 and into the room 30 in a desired manner. Accordingly, the diffusers 20 may discharge the conditioned air 34 into a space 36 of the room 30.

In some examples, the building 10 may include a dropped ceiling 40 (e.g., ceiling tiles) that may be suspended from a ceiling structure 42 (e.g., framework) of the building 10. At least a portion of the ductwork 14 and the diffuser assemblies 32 may be located in a space (e.g., plenum space) formed between the ceiling structure 42 and the dropped ceiling 40. In other examples, the ductwork 14 and/or the diffuser assemblies 32 may be located in any other suitable region of the building 10. For example, the ductwork 14, the diffuser assemblies 32, or both, may be partially or fully integrated (e.g., installed, mounted) into the ceiling structure 42 of the building 10 and/or located within walls 44 or a floor 46 of the building 10.

The diffuser assemblies 32 may further include a lighting system 48 having lighting elements 50 (e.g., LED strips, fluorescent lamps, bulbs, light emitters) coupled to the diffusers 20. The lighting elements 50 may be configured to illuminate or otherwise provide light to the space 36 of the room 30 while occupying common visual spaces with the diffusers 20 (e.g., in and/or along the dropped ceiling 40). In this way, the diffuser assemblies 32 may provide both air distribution and lighting functionalities in an integrated assembly. The resulting design may contribute to an aesthetic cohesiveness of the room 30 by reducing the use and/or accommodation of separate installations for the diffusers and separate light fixtures.

Figure 3:
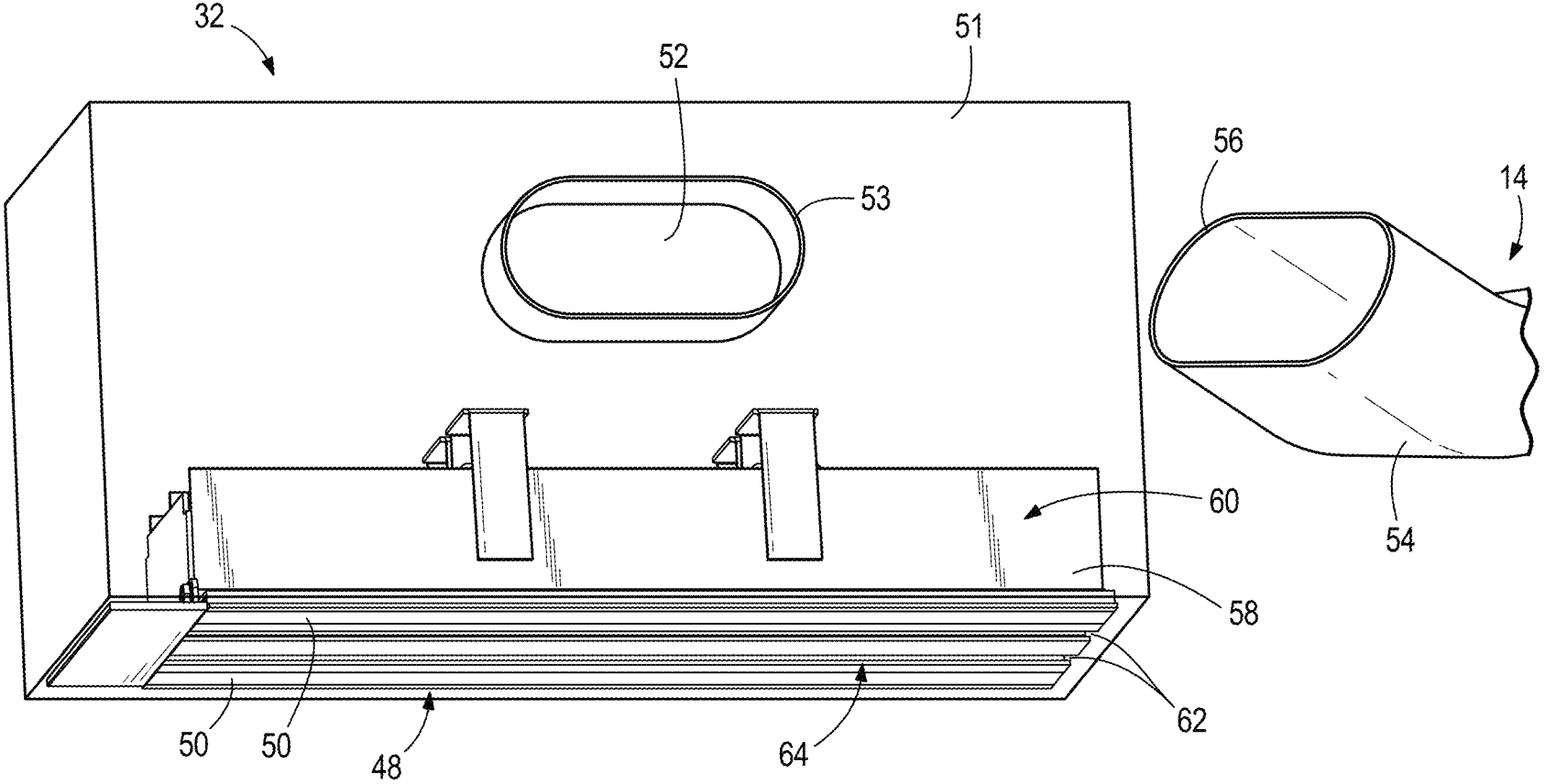
FIG. 3 is a perspective view of an example of a diffuser assembly, in accordance with an aspect of the present disclosure.

FIG. 3 is a perspective view of an example of the diffuser assembly 32. The illustrated diffuser assembly 32 is configured as a linear slot diffuser, although aspects of the present disclosure are also applicable to other types and configurations of diffusers. In the illustrated example, the diffuser assembly 32 includes a housing 51 (e.g., plenum box) having an inlet 52 surrounded by a flange 53. A duct 54 of the ductwork 14 may include an end portion 56 that is configured to extend into, extend about, couple to, and/or otherwise be fluidly connected to the inlet 52. In some examples, an adapter may be disposed between the flange 53 and the duct 54, whereby the adapter facilitates a fluidic and/or sealed connection between the housing 51 and the duct 54. As such, the duct 54 may direct a conditioned air flow (e.g., a cooled air flow, a heated air flow, a dehumidified air flow) that may be generated by the HVAC unit 12, for example, through the inlet 52 and into an interior volume of the housing 51. The diffuser assembly 32 may discharge the conditioned air flow received from the duct 54 within a diffuser frame 58 housed within the housing 51. The diffuser frame 58 may include one or more frame members 60 defining one or more air flow paths 122 through one or more outlets 62 (e.g., outlet ports, slots, gaps) of the diffuser assembly 32. In an installed configuration, the outlet(s) 62 may be exposed to or otherwise fluidly coupled to the space 36 of the room 30. For example, a lower end 64 of the diffuser assembly 32 may align with a lower surface of a ceiling (e.g., ceiling structure 42, dropped ceiling 40) or wall (e.g., wall 44) of the room 30. In this way, a lower end of the diffuser assembly 32 (e.g., outlets 62) may be flush with the ceiling or protrude minimally from the ceiling. In this manner, the diffuser assembly 32 may facilitate distribution and/or dispersion of the conditioned air flow received from the duct 54 into the space 36 of the room 30, for example.

As discussed above, the diffuser assembly 32 further includes the lighting system 48 configured to discharge and/or direct light into the room 30. The lighting system 48 may include the lighting elements 50 coupled to the lower end 64 of the diffuser assembly 32. For example, the lighting elements 50 may be coupled to one or more of the frame members 60 (e.g., adjacent to the outlets 62). In an installed configuration, the lighting elements 50 may be flush with the ceiling. In other configurations, the lighting elements 50 may appear to protrude from the ceiling.

Figure 4:
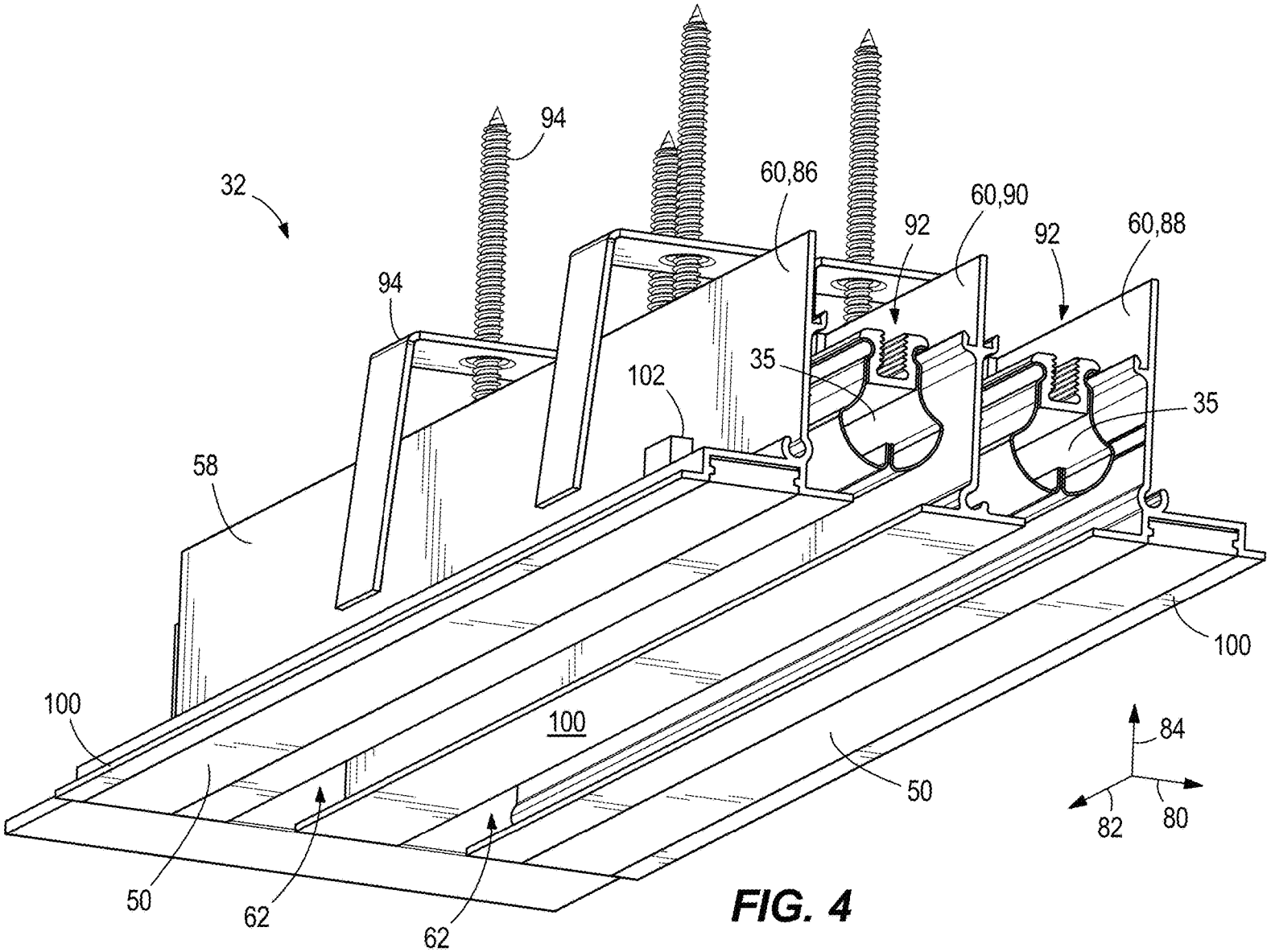
FIG. 4 is a cutaway perspective view of an example of a diffuser assembly, in accordance with an aspect of the present disclosure.

FIG. 4 is a perspective cutaway view of a portion of an example of the diffuser assembly 32. To facilitate discussion, the diffuser assembly 32 may be described with reference to a lateral axis 80 (e.g., x-axis), a longitudinal axis 82 (e.g., z-axis), and a vertical axis 84 (e.g., y-axis). As discussed above, the diffuser frame 58 of the diffuser assembly 32 may include one or more frame members 60. In the illustrated example, the frame members 60 include a first frame member 86 (e.g., outer frame member, L-section beam), a second frame member 88 (e.g., outer frame member, L-section beam), and a third frame member 90 (e.g., inner frame member, T-section beam) coupled to one another to form the diffuser frame 58. Each of the frame members 60 extends along the longitudinal axis 82 with a profile (e.g., cross-section) oriented in a plane generally defined by the lateral axis 80 and the vertical axis 84. The profile may be designed to direct the conditioned air flow in a desired manner (e.g., into the room 30), to enable mounting of the diffuser assembly 32 to the ceiling, and/or to accommodate installation of the lighting system 48 (e.g., lighting elements 50).

The frame members 60 are spaced apart along the lateral axis 80, forming gaps 92 in the lateral spaces therebetween. For example, one of the gaps 92 is formed in the lateral space between the first frame member 86 and the third frame member 90, and another of the gaps 92 may be formed in the lateral space between the second frame member 88 and the third frame member 90. The conditioned air flow received by the diffuser assembly 32 from the duct 54 may be directed through the gaps 92. In this way, the frame members 60 may guide the conditioned air flow through the gaps 92 and out of the diffuser assembly 32 via the outlets 62. In other examples, the diffuser frame 58 may include fewer frame members 60 (e.g., two) or more frame members 60 (e.g., four, five, ten). For example, another example of the diffuser assembly 32 may have two frame members 60 defining a single gap through which the conditioned air flow is directed and discharged from the diffuser assembly 32.

The diffuser assembly 32 may further include one or more of the pattern controllers 35 disposed within the gaps 92 between the frame members 60. The illustrated example includes a first pattern controller 35 in the gap 92 between the first frame member 86 and the third frame member 90, and a second pattern controller 35 in the gap 92 between the third frame member 90 and the second frame member 88. The conditioned air flow may travel from the housing 51, into the gaps 92, and toward the pattern controllers 35. The pattern controllers 35 may include blades, beams, or other structures that are shaped (e.g., curved) and positioned to diffuser the air flow through the gap 92. In general, the pattern controllers 35 may be manually adjustable, automatically adjustable (e.g., via an electronic control unit), or adjustable by forces exerted thereon by incoming air. In this way, the pattern controllers 35 may diffuse the conditioned air flow in a desired manner as the conditioned air flow is discharged from the outlets 62.

Additionally, the diffuser assembly 32 may include mounting hardware 94 configured to enable installation of the diffuser assembly 32 in the ceiling (e.g., ceiling structure 42, dropped ceiling 40). The mounting hardware 94 may include mounting brackets and/or clips designed to secure the diffuser assembly 32 to the ceiling. Additionally, the mounting hardware 94 may include screws, bolts, rods, and/or anchors configured to secure the mounting brackets to the ceiling. For example, the diffuser assembly 32 may be coupled to the ceiling structure 42 via the screws and the mounting brackets such that the diffuser assembly 32 is suspended from the ceiling structure 42 down to the plane of the dropped ceiling 40. The bottom of the diffuser assembly 32 (e.g., outlets 62) may be generally level and/or flush with the dropped ceiling 40 in an installed configuration.

The frame members 60 may have flanges 100 positioned at lower ends of the frame members 60. Some of the flanges 100 may be designed to direct the conditioned air flow, enable mounting of the diffuser assembly 32 to the ceiling, and to establish visual borders around the diffuser assembly 32, including around each of the outlets 62. The lighting system 48 may be integrated with the diffuser assembly 32 in a harmonious manner such that the lighting elements 50 appear to be "built-in" to some of the flanges 100. In some examples, the lighting elements 50 may be so subtly "hidden" in the diffuser assembly 32 that the flanges 100 themselves appear to glow when the lighting elements 50 are activated. When inactive, the lighting elements 50 may visually blend in with the flanges 100, thereby providing an appearance of a traditional diffuser assembly that does not include the lighting system 48. That is, the lighting elements 50 may be adapted into the form of part of the diffuser assembly 32, such that the resulting integrated assembly provides an aesthetic benefit and/or improvement to the space (e.g., room 30) having the diffuser assembly 32 installed therein. The lighting system 48 may include a driver component 102 configured to regulate power to or otherwise control operation of the lighting elements 50. For example, the driver component 102 may receive a power from a power source, such as via a cable. In some examples, the driver component 102 may be configured to receive control signals or instructions (e.g., from a control system), and the driver component 102 may operate the lighting elements 50 based on the control signals. For example, the driver component 102 may include processing circuitry or other circuitry configured to control operation of the lighting elements 50.

Figure 5:
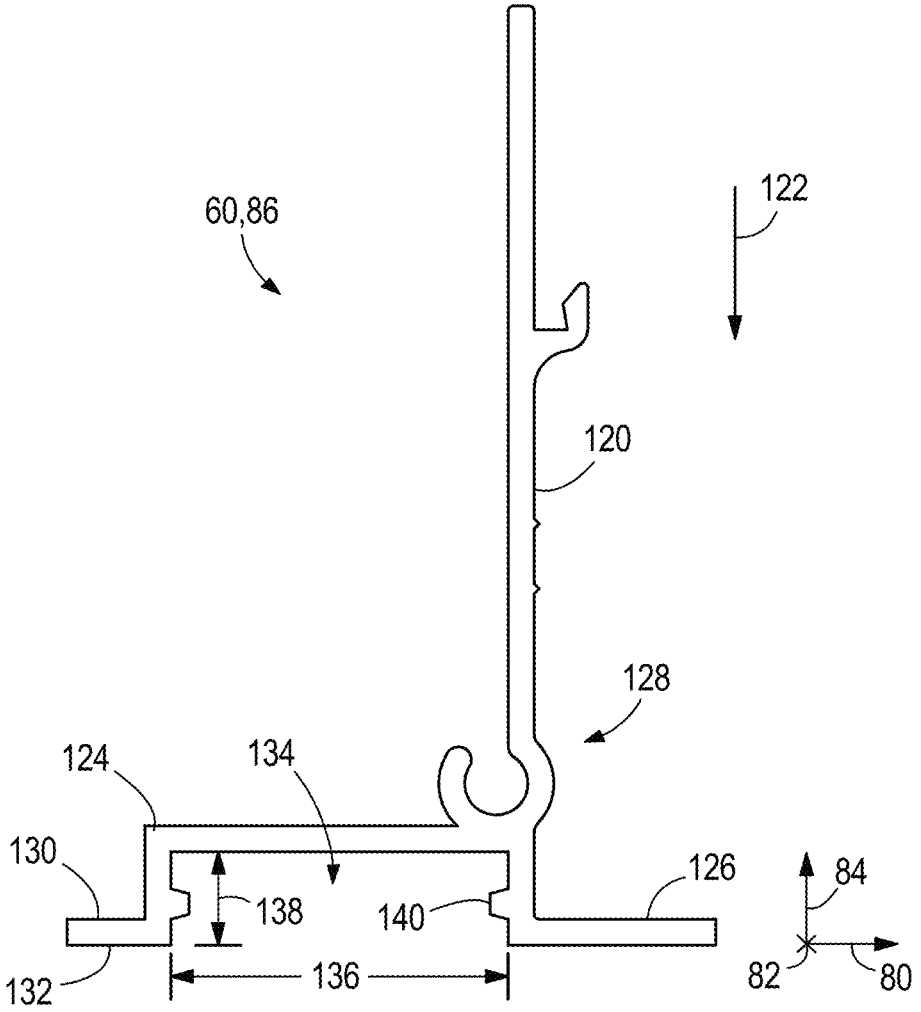
FIG. 5 is a cross-sectional side view of an example of a frame member of a diffuser assembly, in accordance with an aspect of the present disclosure.

FIG. 5 illustrates a side cross-sectional view of one of the frame members 60. For example, the illustrated frame member 60 may be an example of the first frame member 86 (e.g., an outer frame member) shown in FIG. 4. It should be appreciated that other frame members 60, including the second frame member 86, may include similar elements and/or features as the illustrated first frame member 88. As discussed above, the frame member 60 has a profile (e.g., cross-sectional profile) oriented in a plane generally defined by the lateral axis 80 and the vertical axis 84. The profile extends (e.g., extrudes) along a length of the frame member 60 along the longitudinal axis 82. The profile may be designed to direct the conditioned air flow, as well as to accommodate installation of one or more components of the lighting system 48. To this end, the frame member 60 includes a frame wall 120 configured to establish and/or define an air flow path 122 for the conditioned air flow directed through the diffuser assembly 32. The frame wall 120 may enclose the air flow path 122 within the diffuser assembly 32. Additionally, the frame wall 120 may define a separation between the gaps 92. As shown, the frame walls 120 of the first frame member 86 and third frame member 90 define a first air flow path 122 positioned therebetween. Also, the frame walls 120 of the second frame member 88 and third frame member 90 define a second air flow path 122 positioned therebetween. In other examples, the third frame member 90 may be omitted such that the frame walls 120 of the first frame member 86 and second frame member 88 define a single air flow path 122 positioned therebetween. In still other examples, there may be greater than two air flow paths.

The frame member 60 may further include a border flange 124 (e.g., a first flange, a first flange section) and/or an inner flange 126 (e.g., a second flange, a second flange section) at a lower end 128 of the frame member 60 (with respect to the vertical axis 84). The inner flange 126 extends inwardly and partially across the gap 92 and into the air flow path 122, contributing to diffusion of the conditioned air flow. As mentioned above, the room 30 may be fluidly coupled to the diffuser assembly 32 via an opening in the ceiling. An upper surface 130 of the border flange 124 may be configured to rest against a lower surface of the ceiling around the opening while a remaining portion of the frame member 60 is disposed in a space above the ceiling. In other examples, a lower surface 132 of the border flange 124 may be level (e.g., flush) with a lower surface of the ceiling, such that the entire frame member 60 is disposed within the opening of the ceiling. In any case, the border flange 124 extends outwardly and may establish a border around the opening. In this way, the border flange 124 may fluidly separate the room 30 from a space above the ceiling (e.g., a plenum space), as well as visually emphasize the edges of the diffuser assembly 32.

The frame member 60 may include a recess 134 (e.g., groove, channel, concavity, trench) in which one or more lighting elements 50 may be installed. The border flange 124 may be shaped based on a contour of the lighting element 50, such that the recess 134 defines a geometry configured to receive, accommodate, and/or secure the lighting element 50 therein via the contour. For example, the lighting element 50 may have a width along the lateral axis 80, a height along the vertical axis 84, and a length along the longitudinal axis 82. Fittingly, the recess 134 may have a width 136 and a height 138 corresponding to the width, height, and/or length of the lighting element 50. In this way, the recess 134 may be shaped to receive the lighting element 50.

Figure 6:
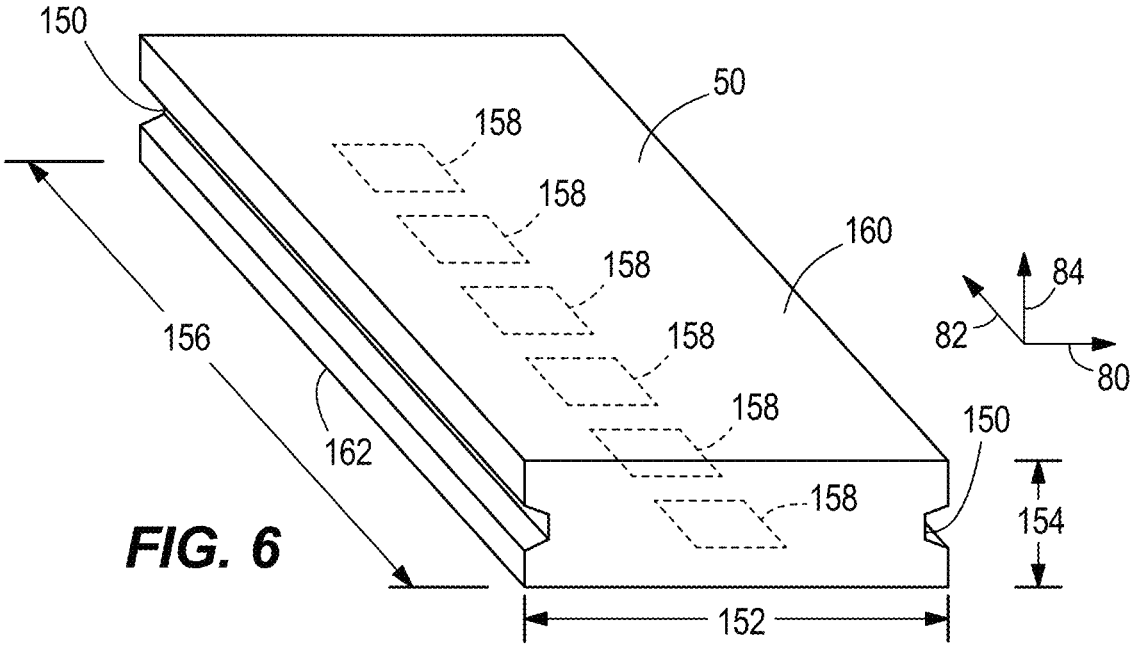
FIG. 6 is a perspective view of an example of a lighting element of a diffuser assembly, in accordance with an aspect of the present disclosure.

Additionally or alternatively, the lighting element 50 may be shaped to fit within the recess 134. That is, the lighting element 50 may include an engagement interface that is complementary to an engagement interface of the recess 134, as discussed in greater detail below. For example, the recess 134 may include one or more ridges 140 (e.g., protrusions, extensions) extending along a length of the recess 134 in the longitudinal direction of the longitudinal axis 82. The ridges 140 may be configured to engage with a portion of the lighting element 50 in order to retain the lighting element 50 in place within the recess 134. For example, FIG. 6 is a perspective view of an example of the lighting element 50 having grooves 150 corresponding to the shape and position of the ridge 140, such that the shape of the lighting element 50 with the grooves 150 is configured to extend within the profile of the recess 134 having the ridges 140. In other examples, the recess 134 may include grooves 150, and the lighting element may include the ridges.

As mentioned above, the lighting element 50 may have a width 152 along the lateral axis 80, a height 154 along the vertical axis 84, and a length 156 along the longitudinal axis 82. The width 152, height 154, and length 156 of the lighting element 50 may correspond to the width 136, height 138, and length of the recess 134. As such, when the lighting element 50 is installed within the recess 134, the bottom of the lighting element 50 may be level (e.g., flush) with the lower surface 132 of the border flange 124 and/or the inner flange 126. As a result, the border flange 124, the inner flange 126, and the lighting element 50 may be joined to provide the appearance of a unified surface across a border of the diffuser assembly 32.

The lighting element 50 may include individual light emitters 158 (e.g., LED emitters). For example, the lighting element 50 may include an LED strip in which the individual light emitters 158 are mounted on a circuit board. The LED strip may be housed within a housing 160 of the lighting element 50. In some examples, the lighting element 50 may include a light-diffusing surface 162 on the underside of the lighting element 50 so that light produced by the individual light emitters 158 is diffused to give the appearance of a continuous, cohesive light source. For example, the light-diffusing surface 162 may be formed from translucent and/or frosted plastic (e.g., polycarbonate, acrylic).

The frame member 60 may provide thermal management for reliable operation for the lighting system 48 by acting as a heat sink in thermal contact with electronic components including the lighting element 50. For example, the frame member 60 may be formed from a metal (e.g., aluminum) and configured to dissipate heat from (e.g., generated by) the lighting system 48.

Figure 7:
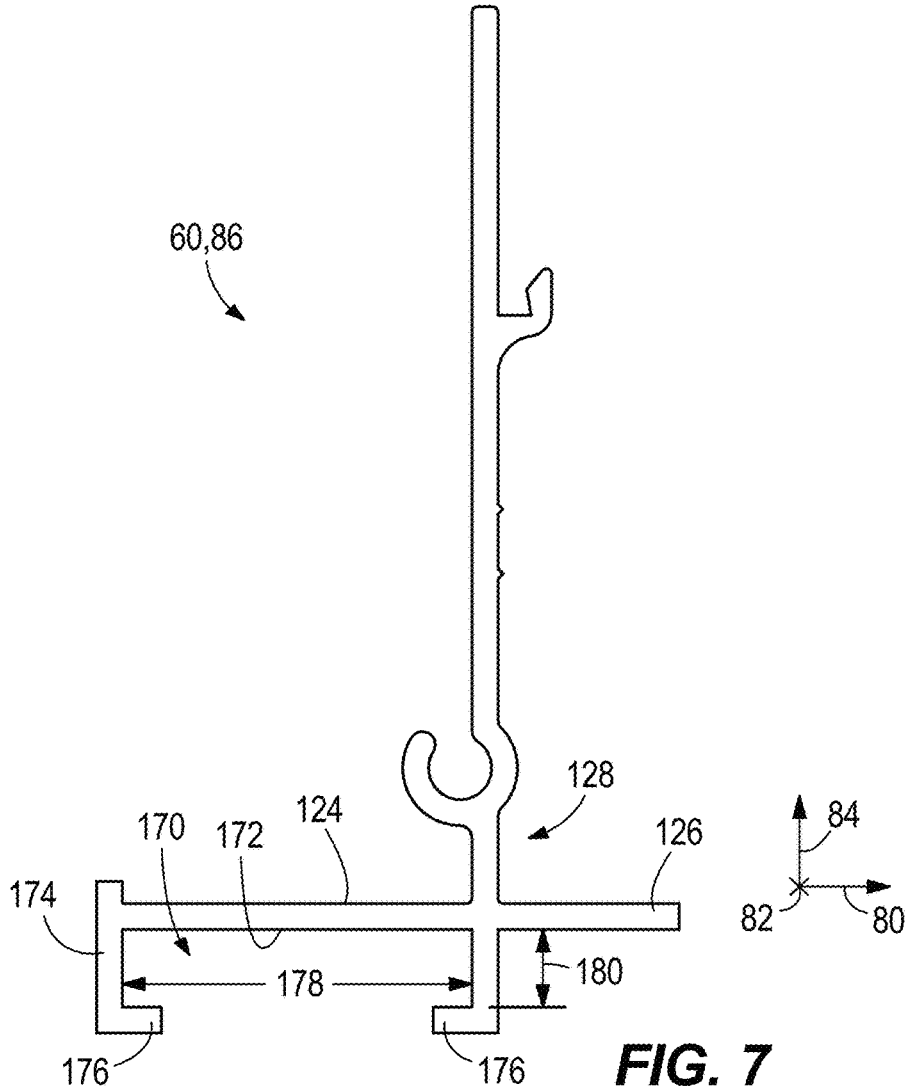
FIG. 7 is a cross-sectional side view a frame member of a diffuser assembly, in accordance with an aspect of the present disclosure.

FIG. 7 is a cross-sectional side view of an example of one of the frame members 60 (e.g., first frame member 86, outer frame member), illustrating a cavity 170 (e.g., channel) formed in an underside 172 of the border flange 124 that is configured to receive and accommodate the lighting element 50. The cavity 170 is defined by walls 174 extending downward of the border flange 124. The cavity 170 may include lips 176 (e.g., ledges) at a lower end of the walls 174 to support and retain the lighting element 50 within the cavity 170. The cavity 170 may have a width 178 between the walls 174, a height 180 from the underside 172 of the border flange 124 to the lips 176, and a length along the length of the frame member 60. The width 178, height 180, and length of the cavity 170 may be selected to accommodate installation of the lighting element 50.

Figure 8:
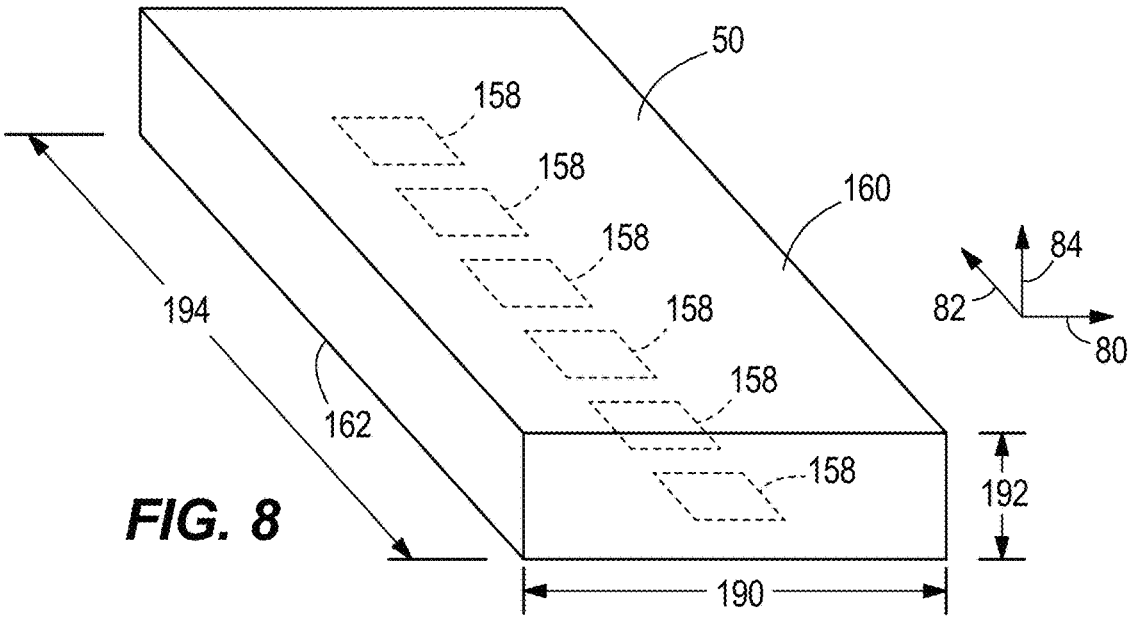
FIG. 8 is a perspective view of an example of a lighting element of a diffuser assembly, in accordance with an aspect of the present disclosure.

For example, FIG. 8 is a perspective view of an example of the lighting element 50 having a profile designed to fit within the cavity 170 of the frame member 60. The lighting element 50 may have a rectangular shape with a width 190, height 192, and length 194 corresponding to the width 178, height 180, and length of the cavity 170. In this way, the cavity 170 may be shaped to receive the lighting element 50. Conversely, the lighting element 50 may be shaped to fit within the cavity 170. The lips 176 may support the bottom of the lighting element 50 to hold the lighting element 50 within the cavity 170.

Figure 9:
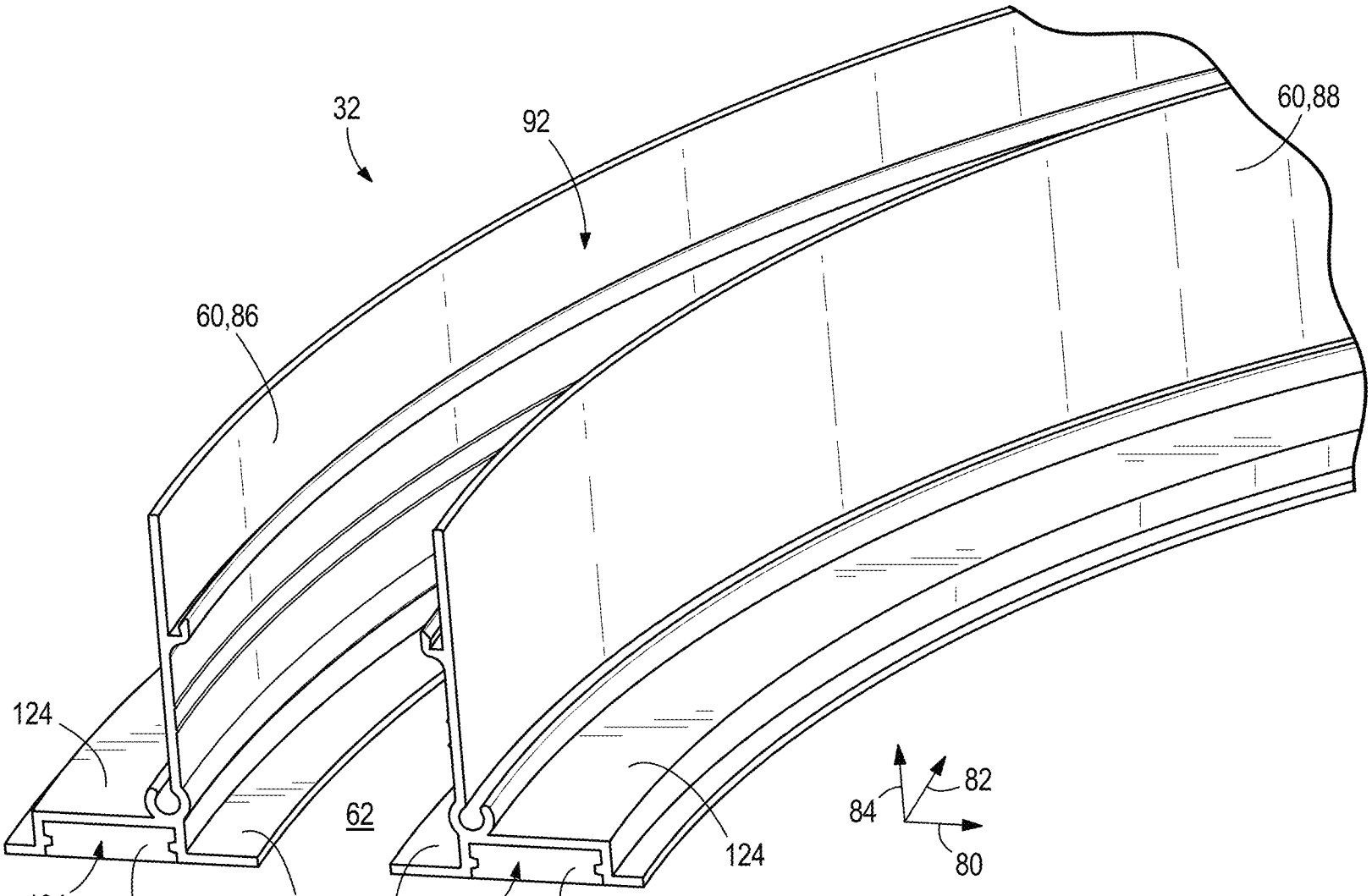
FIG. 9 is a partial perspective view of an example of a diffuser assembly having a curved shape, in accordance with an aspect of the present disclosure.

FIG. 9 is a partial perspective view of an example of the diffuser assembly 32 having a curved shape. The frame members 60 may have the cross-sections detailed in FIGS. 5 and 7. In this example, the frame members 60 may extend along a curved (e.g., arcuate, circular, splined) path to form a desired shape or pattern along the ceiling. Similarly, the lighting elements 50 may be curved or flexible to extend along the path of the frame members 60 and to be retained within the recesses 134 or the cavities 170.

Figure 10:
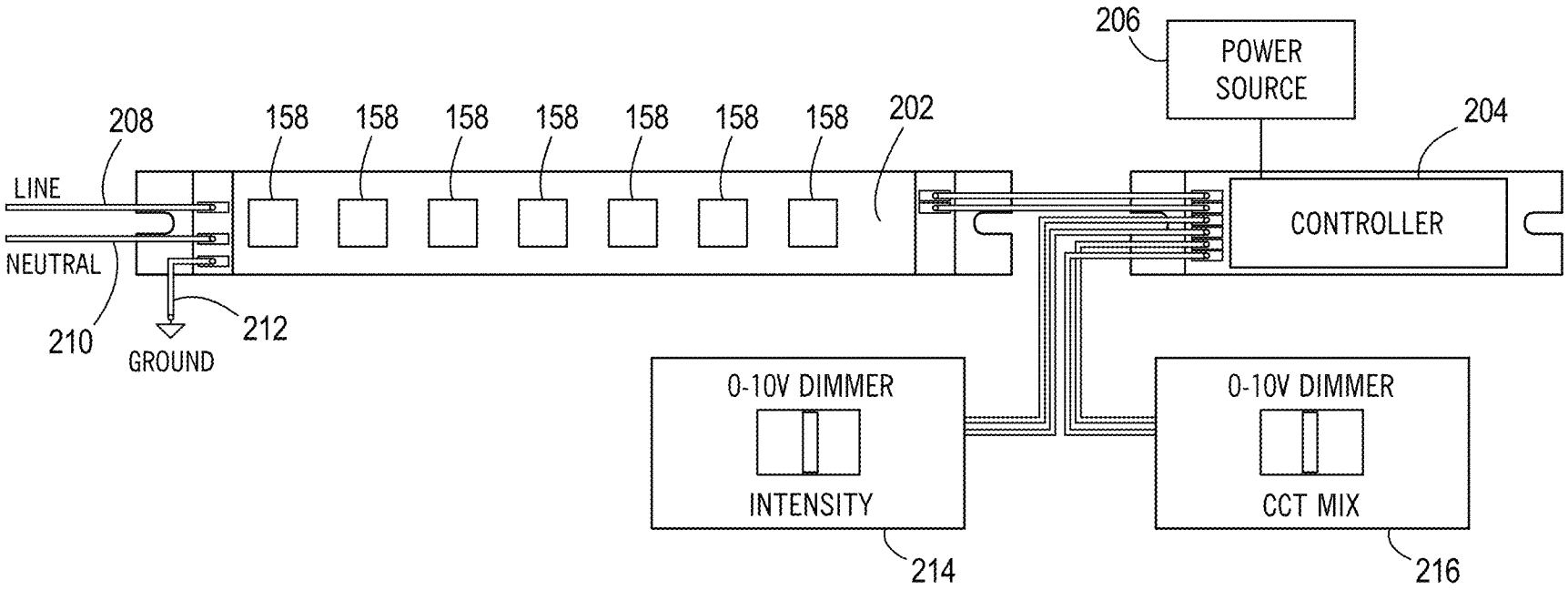
FIG. 10 is a schematic of an example of a lighting system of a diffuser assembly, in accordance with an aspect of the present disclosure.

FIG. 10 is a schematic of an example of the lighting system 48. The individual light emitters 158 (e.g., LED emitters) may be mounted on a circuit board 202 (e.g., LED strip, flexible circuit board) and operated by a controller 204 (e.g., which is included in the driver component 102). The controller 204 may supply the individual light emitters 158 with electrical power (e.g., current) received from a power source 206 (e.g., battery, line power). Conducting through the circuit board 202 are a line rail 208, a neutral rail 210, and a ground rail 212, facilitating electrical connections to the individual light emitters 158. Additionally, the lighting system 48 may include an intensity dimmer 214 and/or a correlated color temperature (CCT) mix dimmer 216 coupled to the controller 204. The intensity dimmer 214 and the CCT mix dimmer 216 enable adjustment of brightness and color temperature of light emitted by the light emitters 158.

In some examples, the controller 204 may be configured to receive control signals or instructions (e.g., from a control system) to operate the lighting system 48 based on the control signals. For example, the controller 204 may include processing circuitry or other circuitry configured to control operation of the lighting element 50. The processing circuitry may include one or more microprocessors, which may execute software (e.g., executable instructions, code) for controlling components of the light control system. The processing circuitry may include multiple microprocessors, one or more "general-purpose" microprocessors, one or more special-purpose microprocessors, one or more reduced instruction set (RISC) processors, and/or one or more application specific integrated circuits (ASICS), or some combination thereof. The lighting system 48 (e.g., the controller 204) may also include a memory (e.g., a memory device), which may store information, such as instructions, control software, look up tables, configuration data, code, etc. The memory may include a volatile memory, such as random access memory (RAM), and/or a nonvolatile memory, such as read-only memory (ROM). The memory may store a variety of information and may be used for various purposes. For example, the memory may store processor-executable instructions including firmware or software for the processing circuitry to execute, such as instructions for controlling components of the light control system. In some examples, the memory is a tangible, non-transitory, machine-readable medium that may store machine-readable instructions for the processing circuitry to execute. The memory may include ROM, flash memory, a hard drive, or any other suitable optical, magnetic, or solid-state storage medium, or a combination thereof. The memory may store data, instructions, and any other suitable information. In some examples, the memory may store instructions to enable control of the lighting system 48, such as adjusting an intensity of light emitted by the lighting element 50 based on instructions, data, or feedback received by the light controller. For example, the light controller may receive user inputs via a user control device (e.g., control device 16, infrared transmitter, Bluetooth, Wi-Fi) to change one or more parameters of the light, such as intensity, color, color change pattern. In an example, the controller may enable a music-synchronization mode, wherein behavior of the light is correlated with music. It should be noted that the controller 204 may be a dedicated controller of the lighting system 48, or the light controller may control multiple lighting devices including other lighting systems 48 and traditional lighting devices.

The power source may be a wall outlet, utility grid, a battery, a generator, a solar panel, or other suitable source of electrical power. The controller 204 may transform (e.g., rectify) received power into power suitable for use by the lighting system 48. The lighting system 48 may be configured to utilize low voltage power, which may enable installation via a general technician, such as an HVAC contractor.

Some or all of these components of the lighting system 48 may be disposed within the housing 160 of the lighting element 50. Alternatively, the housing 160 may house the circuit board 202, while the controller 204, the power source 206, the intensity dimmer 214, and the CCT mix dimmer 216 are disposed elsewhere in the diffuser assembly 32 and connected to the circuit board 202 via wires or cables. For example, these components may be attached to one of the frame members 60 on the frame wall 120 or on top of the border flange 124.

As described in detail above, examples of the present disclosure are directed to an assembly that integrates a lighting system with a diffuser of an HVAC system. The diffusers may be mounted in a ceiling having an opening that connects the room to ductwork configured to deliver an air flow. Lighting elements of the lighting system may be recessed in border flanges of the diffuser. In this way, the diffuser and the lighting elements may occupy a shared visual space in a ceiling, improving aesthetics of an environment.

While only certain features and examples have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative examples. It is, therefore, to be understood that the appended claims are intended to cover all such modifications and changes as fall within the true spirit of the disclosure.

Furthermore, in an effort to provide a concise description of the exemplary examples, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An integrated diffuser assembly for a heating, ventilation, and air conditioning (HVAC) system, comprising:

a diffuser including a diffuser frame configured to guide an air flow along an air flow path to discharge the air flow to a conditioned space, the diffuser frame comprising a first frame member including a first frame wall configured to be at least partially positioned within a plenum box of the HVAC system and partially extending along a length of the diffuser, a flange extending outwardly from the first frame wall along the length of the diffuser, and a channel extending along the flange; and a second frame member having a second frame wall configured to be at least partially positioned within the plenum box and extending along the length of the diffuser, wherein the first frame wall and the second frame wall define the air flow path; and a lighting element coupled to the diffuser frame and disposed within the channel such that the lighting element is positioned outwardly from the air flow path.

2. The integrated diffuser assembly of claim 1, wherein the lighting element includes an engagement interface that is complementary to an engagement interface of the channel.

3. The integrated diffuser assembly of claim 1, wherein the diffuser further includes a pattern controller positioned between the first frame wall and the second frame wall and within the air flow path, the pattern controller configured to adjust the air flow into the conditioned space.

4. The integrated diffuser assembly of claim 3, wherein the flange is a first flange, and wherein the first frame member includes a second flange extending inwardly from the first frame wall along the length of the diffuser.

5. The integrated diffuser assembly of claim 1, wherein the flange is a first flange, the channel is a first channel, and the air flow path is a first air flow path, and the lighting element is a first lighting element, and wherein the diffuser frame further includes a third frame member including a third frame wall at least partially positioned within the plenum box and partially extending along the length of the diffuser, a second flange extending outwardly from the third frame wall along the length of the diffuser, and a second channel extending along the second flange, wherein the second frame wall and the third frame wall define a second air flow path configured to guide the air flow to the conditioned space; and a second lighting element coupled to the diffuser frame and disposed within the second channel such that the second lighting element is positioned outwardly from the second air flow path.

6. The integrated diffuser assembly of claim 5, wherein the first air flow path and the second air flow path are positioned between the first lighting element and the second lighting element.

7. The integrated diffuser assembly of claim 5, wherein the diffuser further includes a first pattern controller positioned between the first frame wall and the second frame wall and within the first air flow path and a second pattern controller positioned between the second frame wall and the third frame wall and within the second air flow path, the first pattern controller and the second pattern controller each configured to adjust the air flow into the conditioned space.

8. The integrated diffuser assembly of claim 7, wherein the first frame member includes a third flange extending inwardly therefrom along the length of the diffuser and the third frame member includes a fourth flange extending inwardly therefrom.

9. The integrated diffuser assembly of claim 1, wherein the lighting element includes a plurality of light emitters.

10. The integrated diffuser assembly of claim 9, wherein the lighting element includes a circuit board on which the plurality of light emitters is mounted and a lighting element housing in which the circuit board is supported.

11. The integrated diffuser assembly of claim 10, wherein an outer surface of the lighting element housing is flush with an outer surface of the flange.

12. The integrated diffuser assembly of claim 1, wherein one of the channel or the lighting element includes a channel and the other of the channel or the lighting element includes a ridge configured to be received within the channel to thereby couple the lighting element within the channel.

13. The integrated diffuser assembly of claim 12, wherein an outer surface of the lighting element is flush with an outer surface of the flange.

14. The integrated diffuser assembly of claim 1, wherein the flange is an outer flange and further comprising an inner flange extending inwardly from the first frame wall into the air flow path along the length of the diffuser.

15. The integrated diffuser assembly of claim 1, further comprising a mounting fastener configured to enable installation of the diffuser frame relative to the plenum box and positioned inwardly of the first frame wall.

16. The integrated diffuser assembly of claim 1, wherein the first frame wall partially defines the channel.

* * * * *